US009107556B2

(12) United States Patent
Liscio

(10) Patent No.: US 9,107,556 B2
(45) Date of Patent: Aug. 18, 2015

(54) FLOOR CLEANING APPARATUS

(71) Applicant: WETROK AG, Kloten (CH)

(72) Inventor: Michele Liscio, Milan (IT)

(73) Assignee: WETROK AG, Kloten (CH)

( * ) Notice: Subject to any disclaimer, the term of this patent is extended or adjusted under 35 U.S.C. 154(b) by 185 days.

(21) Appl. No.: 13/663,985

(22) Filed: Oct. 30, 2012

(65) Prior Publication Data

US 2014/0115820 A1 May 1, 2014

(51) Int. Cl.

| | |
|---|---|
| ***A47L 5/10*** | (2006.01) |
| ***A47L 11/293*** | (2006.01) |
| ***A47L 11/40*** | (2006.01) |

(52) U.S. Cl.

CPC ..... *A47L 11/293* (2013.01); *A47L 11/4016* (2013.01); *A47L 11/4083* (2013.01)

(58) Field of Classification Search

USPC ..... 15/327.2, 320, 354, 385, 49.1, 98, 15/340.2–340.4

See application file for complete search history.

(56) References Cited

U.S. PATENT DOCUMENTS

| | | | | |
|---|---|---|---|---|
| 4,000,538 | A | 1/1977 | Tissier | |
| 5,465,456 | A | 11/1995 | Fellhauer et al. | |
| 5,566,422 | A * | 10/1996 | Geyer | 15/320 |
| 6,105,203 | A * | 8/2000 | Hueppi et al. | 15/320 |
| 6,842,940 | B2 * | 1/2005 | Christopher et al. | 15/320 |
| 7,302,733 | B2 * | 12/2007 | Rau et al. | 15/320 |
| 7,337,490 | B2 * | 3/2008 | Goff | 15/320 |
| 8,370,991 | B2 * | 2/2013 | Paliobeis et al. | 15/320 |

FOREIGN PATENT DOCUMENTS

| | | |
|---|---|---|
| DE | 2510233 A1 | 11/1975 |
| EP | 0017519 B1 | 8/1984 |

* cited by examiner

*Primary Examiner* — Dung Van Nguyen

(74) *Attorney, Agent, or Firm* — Rankin, Hill & Clark LLP

(57) ABSTRACT

Floor cleaning apparatus (1) comprising: a) a front portion (16) and a rear portion (17); the rear portion (17) comprising two lateral rear wheels (3); b) a chassis (2); and c) a cleaning unit (4) attached to the chassis (2), wherein the cleaning unit (4) comprises: a first tank (15); a second tank (13); at least one rotatable brush (20), wherein the at least one brush (20) is arranged in the front portion (16) of the cleaning apparatus (1) so as to be contactable with the floor (12) to be cleaned; and a suction device (25) including at least a rear suction unit (7) arranged rearward of the at least one brush (20), and wherein the first tank (15) is attached to the chassis (2) and is configured as a receptacle with its smallest dimension X extending essentially vertically; and the second tank (13) is arranged in the rear portion (17) of the cleaning apparatus (1) and is configured as a receptacle having a smallest dimension Z in the forward or rearward travel direction of the cleaning apparatus (1).

26 Claims, 4 Drawing Sheets

FLOOR CLEANING APPARATUS

BACKGROUND OF THE INVENTION

1. Field of the Invention

The invention relates to a floor cleaning apparatus and particularly to a floor cleaning apparatus having a reduced underclearance.

2. Description of the Related Art

A mobile floor cleaning apparatus for wet cleaning of a floor is known from U.S. Pat. No. 5,465,456 FELLHAUER. This known cleaning apparatus comprises a first tank for a cleaning solution which is pumped through a hose to a solution spray bar arranged in front of the brush. A second tank for the dirty solution which is sucked up by means of a vacuum shoe is arranged above the first tank. A drawback of this known cleaning apparatus is that the configuration and arrangement of the first and second tank result in a large height of the cleaning apparatus so that a cleaning of the floor under tables or benches cannot be performed.

BRIEF SUMMARY OF THE INVENTION

It is an object of the invention to provide a floor cleaning apparatus for wet cleaning of a floor which has a reduced underclearance.

The invention solves the posed problem with a floor cleaning apparatus comprising a front portion and a rear portion with two lateral rear wheels, a chassis and a cleaning unit attached to the chassis, wherein the cleaning unit essentially comprises a first tank, a second tank, at least one rotatable brush, wherein the at least one brush is arranged in the front portion of the cleaning apparatus so as to be contactable with the floor to be cleaned and a suction device including at least a rear suction unit arranged rearward of the at least one brush. The first tank is configured as a receptacle with a smallest dimension X and is attachable to the chassis with its smallest dimension X extending essentially vertically and the second tank is configured as a receptacle having a smallest dimension Z and is attachable to the rear portion of the cleaning apparatus with its smallest dimension Z oriented in the forward or rearward travel direction of the cleaning apparatus.

The advantage of the floor cleaning apparatus according to the invention is essentially to be seen in the fact that due to the arrangement of the first tank in a horizontal position and the arrangement of the second tank in the rear portion of the cleaning apparatus a reduced underclearance of the front portion of the cleaning apparatus is achieved so that the front portion of the cleaning apparatus which is provided with the at least one brush and the suction units can be moved under tables or benches.

In a special embodiment the cleaning apparatus can further comprise an elongated member which extends from the rear end of the chassis wherein the second tank is attachable to the elongated member. Preferably, one end of the elongated member is rotatably affixed to the chassis by means of a hinge. This configuration permits the advantage that the elongated member with the second tank attached thereto can be backwardly rotated about the rotational axis of the hinge so as to permit to clean the floor under a table.

Preferably, the hinge has a rotational axis extending in a lateral direction of the cleaning apparatus.

In another embodiment the cleaning apparatus further comprises a handlebar and the elongated member extends from the chassis to the handlebar. Preferably, the second tank has a smallest dimension Z extending essentially perpendicular to a plane defined by the elongated member and the handlebar.

In a further embodiment the elongated member is adjustable and loosenably securable at a selected angle between −90° and +90° with respect to a horizontal plane. This configuration permits the advantage that the elongated member with the second tank attached thereto can be rotated from a vertical position suitable to put aside the cleaning apparatus on a minimum space to a horizontal position permitting a minimum height of the whole cleaning apparatus.

In another embodiment the at least one brush and the rear suction unit define a floor contact region when the cleaning apparatus is in a working position and wherein the first tank extends vertically with respect to the floor contact region to a level of maximum 40 cm, preferably maximum 35 cm. Preferably, each of the first and second tanks has a volume of minimum 7 liters, preferably minimum 9 liters. In a further embodiment each of the first and second tanks has a volume of maximum 12 liters, preferably maximum 10 liters. This configuration allows the advantage that the floor cleaning apparatus can be manually moved in the forward and backward travel direction.

Preferably, the first tank is detachably affixed to the chassis by means of a quick fixing device, and preferably the second tank is detachably affixed to the elongated member by means of a quick fixing device.

Preferably, the first tank is configured as a fresh water tank and the second tank is configured as a recovery water tank.

In a further embodiment the cleaning apparatus further comprises a mechanical actuation device, preferably a lever hoist to rotate the elongated member about the rotational axis of the hinge. By this means the advantage can be achieved that when adjusting the elongated member with the second tank attached thereto from a vertical position to a horizontal position or vice versa the weight of the second tank (recovery water tank) can be lifted or lowered via the lever hoist and must not be manually lifted or lowered by the user.

Preferably, the first tank longitudinally extends over the front and the rear portion of the cleaning apparatus. By this means the smallest dimension X of the first tank and thus the underclearance of the cleaning apparatus can be minimized with respect to a given tank volume.

In another embodiment the chassis has a front end and the first tank tapers towards the front end of the chassis so that the underclearance of the front portion of the cleaning apparatus can be further minimized.

In a further embodiment the rear suction unit is attached to the brush housing by means of a resilient connecting device allowing the rear suction unit to move laterally with respect to the chassis against an elastic resistance provided by the resilient connecting device. The advantage of the floor cleaning apparatus according to the invention is essentially to be seen in the fact that the rear suction bar adapts flexibly to the direction of travel.

In a special embodiment the resilient connecting device comprises an elastic connector which forms a pivot joint affixed to the brush housing by means of a fastener. Preferably, the pivot joint has an axis of rotation extending essentially vertically.

In a further embodiment the rear suction unit comprises a curved suction bar which is preferably configured as an essentially elliptically curved suction bar. By this means the advantage can be achieved that the rear suction bar extends on an arc so that the at least one brush is partially encircled. The elliptically curved suction bar fits better to a portion of the periphery of the pair of brushes.

In again another embodiment the at least one brush is rotatable about a rotational axis extending essentially vertically.

In another embodiment the cleaning apparatus further comprises a front suction unit. Preferably, the front suction unit comprises a front suction channel and a closing mechanism which closes the front suction channel when the cleaning apparatus is moved in a forward travel direction.

In a further embodiment the closing mechanism opens the front suction channel when the cleaning apparatus is in a working position and is moved in a backward travel direction. This configuration allows the advantage that the front suction channel can be opened or closed by simply changing the travel direction of the cleaning apparatus. Preferably, the rear suction unit comprises a rear suction channel which is open during movement of the cleaning apparatus in the forward and backward travel direction. Because the rear suction channel is open in either travel direction the suction volume flow rate of the cleaning unit can simply be increased by moving the cleaning apparatus in the backward travel direction.

In another embodiment the front suction channel comprises a suction opening which is open towards a floor to be cleaned and wherein the closing mechanism comprises a lip wherein a front section of the lip frontally limits the suction opening along its entire length and a rear section of the lip rearwardly limits the suction opening along its entire length. By this means the front section of the lip can be used to close or open the suction opening of the front suction channel.

A BRIEF DESCRIPTION OF THE DRAWINGS

A special embodiment of the invention will be described in the following by way of example and with reference to the accompanying drawings in which.

DETAILED DESCRIPTION OF THE INVENTION

Figure 1:
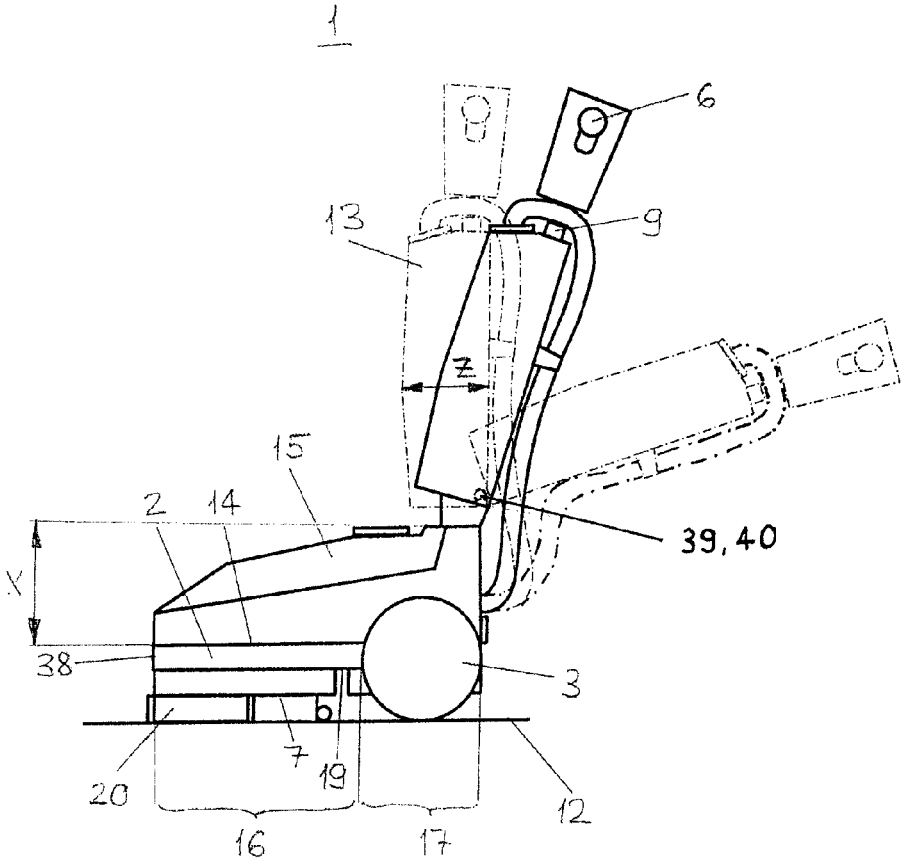
FIG. 1 illustrates a side view of an embodiment of the floor cleaning apparatus according to the invention with the second tank additionally illustrated in a vertical and backward tilted position.

Although the invention is described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting. The terms "comprises", "comprising", "includes", "including", "having" and their conjugates mean "including but not limited to". This term encompasses the terms "consisting of" and "consisting essentially of".

The terms "front", "rear", "forward" and "backward" are understood as being directed to a "forward travel direction" of the cleaning apparatus, i.e. a movement of the cleaning apparatus by manually pushing the handlebar towards the front portion of the cleaning apparatus so that the same moves on the floor to be cleaned with the front portion ahead. The term "backward travel direction" is meant to be the opposite travel direction by pulling the handlebar so that the cleaning apparatus moves on the floor with the rear portion ahead. The wording "lateral" or in "a lateral direction" is understood as located besides or extending in a cross direction with respect to the forward and backward travel direction. Furthermore, the terms "lower side of the chassis", "upper side of the chassis", "above", "below", "vertical" and "horizontal" are referenced to the cleaning apparatus positioned on the floor to be cleaned.

The term "chassis" is understood as being a framework which supports and/or holds in position the various parts of the cleaning apparatus and to which the handlebar is affixed and the rear wheels are rotatably attached.

As used herein, the singular form "a", "an" and "the" include plural references unless the context clearly dictates otherwise. For example, the term "a brush" or "at least one brush" may include a plurality of brushes.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements. As used herein the term "method" refers to manners, means, techniques and procedures for accomplishing a given task including, but not limited to, those manners, means, techniques and procedures either known to, or readily developed from known manners, means, techniques and procedures by practitioners of mechanical engineering.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

FIGS. 1 to 5 illustrate an embodiment of the cleaning apparatus 1 for wet cleaning of a floor 12. The cleaning apparatus 1 essentially comprises a front portion 16, a rear portion 17 with two lateral rear wheels 3, a chassis 2 and a cleaning unit 4 attached to the chassis 2. Exemplarily, the cleaning apparatus 1 can be provided with a handlebar 6 which is suitable to move the cleaning apparatus 1 on a floor 12 to be cleaned. Alternatively, the cleaning apparatus 1 can be driven by a motor and controlled by the operator by means of control means attached to the cleaning apparatus 1 or can be controlled by a remote control. The handlebar 6 can be attached to the chassis 2 by means of an essentially vertically extending elongated member 9, e.g. a post so that the handlebar 6 permits to move the cleaning apparatus 1 manually in a forward and a backward travel direction. In various embodiments of the cleaning apparatus 1 according to the invention the cleaning unit 4 can comprise one or more brushes 20. Exemplarily, but not limiting, the embodiment of the cleaning apparatus 1 illustrated in FIGS. 1 to 5 is provided with a cleaning unit 4 comprising two brushes 20. The two brushes 20 are rotatably attached to a brush housing 22. The brushes 20 are rotatable about a rotational axis 21 each. The brushes 20 can for example, but not limited to, be arranged with their rotational axes 21 extending vertically on opposite sides of the vertical middle plane 18 and essentially vertically to the forward and backward travel direction of the cleaning apparatus. Alternatively, the one or more brushes 20 can be arranged with their rotational axes 21 extending horizontally in a lateral direction of the cleaning apparatus 1.

Further, the cleaning unit 4 can comprise a first tank 15, a second tank 13, preferably two rotatable brushes 20 and a suction device 25 permitting to suck up the dirty cleaning liquid. The first tank 15 is used for fresh water supply while the second tank 13 is used as a recovery water tank into which the dirty cleaning water sucked up from the floor 12 can be delivered by means of the suction device 25 via the flexible tube 33. Furthermore, the cleaning unit 4 can comprise a first electric driving motor (not shown) for driving the vacuum turbine 5 and a second and third electric driving motor (not shown) each for driving one of the two brushes 20. The cleaning apparatus 1 can be provided with a battery 35, preferably a lithium-ion battery to supply the electric driving motors with electric energy. The two brushes 20 can rotate in opposite senses of rotation.

Preferably, the first tank 15 is configured as a fresh water tank and the second tank 13 is configured as a recovery water tank. Furthermore, the first tank 15 can be detachably affixed to the chassis 2 by means of a quick fixing device and the second tank 13 can be detachably affixed to the elongated member 9 by means of a quick fixing device. The first tank 15, i.e. the fresh water tank is connected to a piping and/or flexible tube system (not shown) so as to allow water to flow from the first tank 15 via a nozzle 45 (FIG. 2) to each one brush 20. The brushes 20 are arranged in front of the rear wheels 3 in the front portion 16 of the cleaning apparatus 1 and protrude from the lower side 19 of the chassis 2 so as to be contactable with the floor 12 to be cleaned. The brush housing 22 can be attached to the chassis 2 at the lower side 19 thereof.

As best seen in FIG. 1 the first tank 15 is attachable to the chassis 2 and is configured as a receptacle with its smallest dimension X extending vertically with respect to the forward and backward travel direction of the cleaning apparatus 1. Further, the cleaning apparatus 1 can comprise an elongated member 9 which extends from the chassis 2 to the handlebar 6, wherein the second tank 13 is attachable to the elongated member 9. The second tank 13 has a smallest dimension Z extending essentially perpendicular to a plane defined by the elongated member 9 and the handlebar 6. One end of the elongated member 9 can be rotatably affixed to the chassis 2 by means of a hinge 39 having a rotational axis 40 extending in the lateral direction of the cleaning apparatus 1. By this means the elongated member 9 with the second tank 13 attached thereto can be backwardly rotated about the rotational axis 40 of the hinge so as to permit to clean the floor 12 under a table or under a bench. The elongated member 9 can be adjustable and loosenably securable at a selected angle between −90° and +90° with respect to a horizontal plane. Thus, the elongated member 9 with the second tank 13 attached thereto can be rotated from an essentially vertical position which is suitable to put aside the cleaning apparatus 1 on a minimum space to a horizontal position permitting a minimum overall height of the complete cleaning apparatus 1. The at least one brush 20 and the rear suction unit 7 define a floor contact region 44 when the cleaning apparatus 1 is in a working position and the first tank 15 can extend vertically with respect to the floor contact region 44 to a level of maximum 40 cm, preferably maximum 35 cm. In a preferred embodiment each of the first and second tanks 15, 13 can have a volume of typically 9 liters. In one embodiment the cleaning apparatus 1 can additionally comprise a mechanical actuation device (not shown), preferably a lever hoist to rotate the elongated member 9 about the rotational axis 40 of the hinge 39. By this means the weight of the second tank 13 must not be manually lifted or lowered by the user during an adjustment of the elongated member 9 with the second tank 13 attached thereto from a vertical position to a horizontal position or vice versa. The weight of the second tank 13 can be lifted or lowered by means of the mechanical actuation device. Preferably, the first tank 15 longitudinally extends over the front and the rear portion 16, 17 of the cleaning apparatus 1 so as to have a maximum horizontal cross-sectional area. The first tank 15 can taper towards the front end 38 of the chassis 2 to achieve a low front portion 16 of the cleaning apparatus 1 suitable to clean the floor 12 under e.g. a bench.

Figure 2:
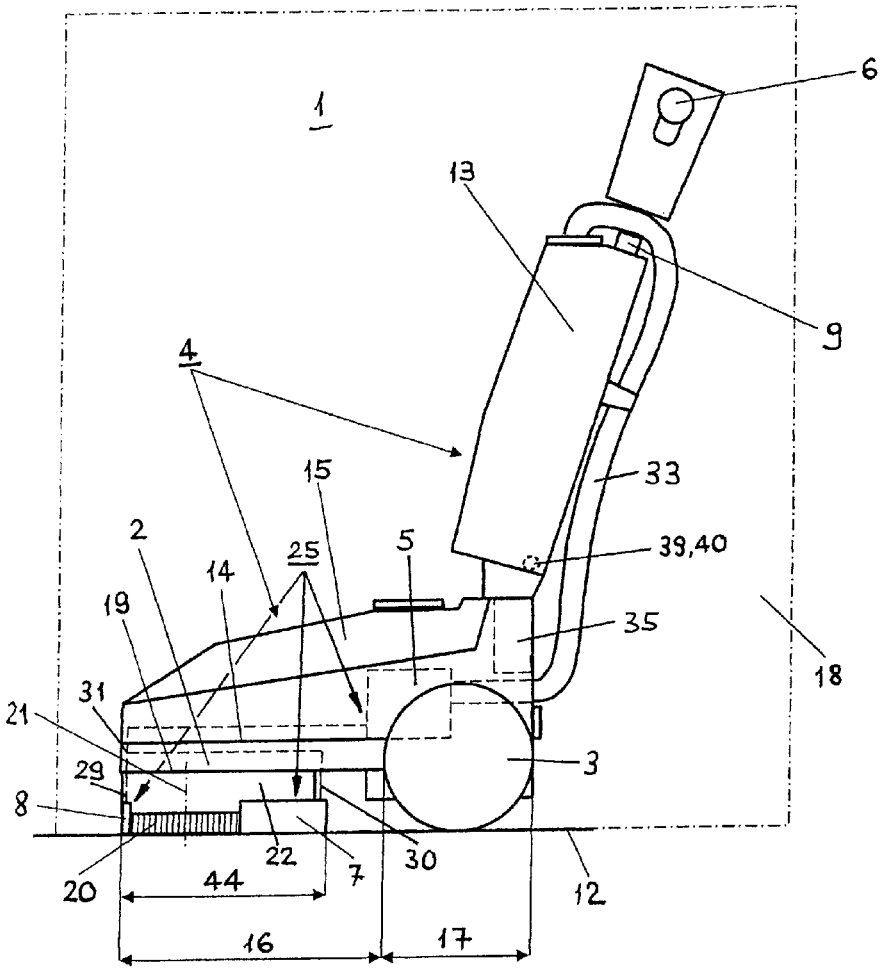
FIG. 2 illustrates a side view of an embodiment of the floor cleaning apparatus according to the invention shown in FIG. 1.
Figure 3:
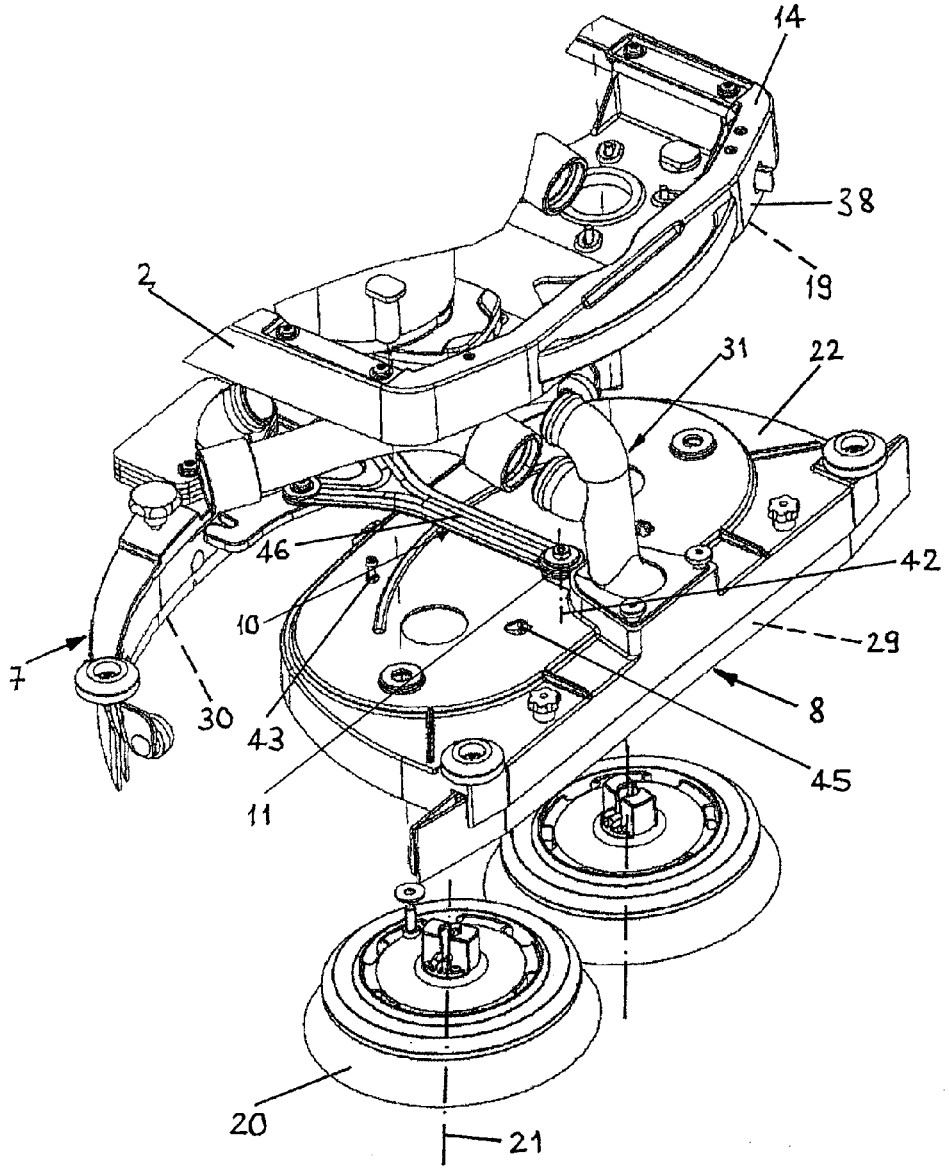
FIG. 3 illustrates an exploded perspective view of the front portion of the embodiment of the floor cleaning apparatus according to the invention shown in FIG. 1.
Figure 4:
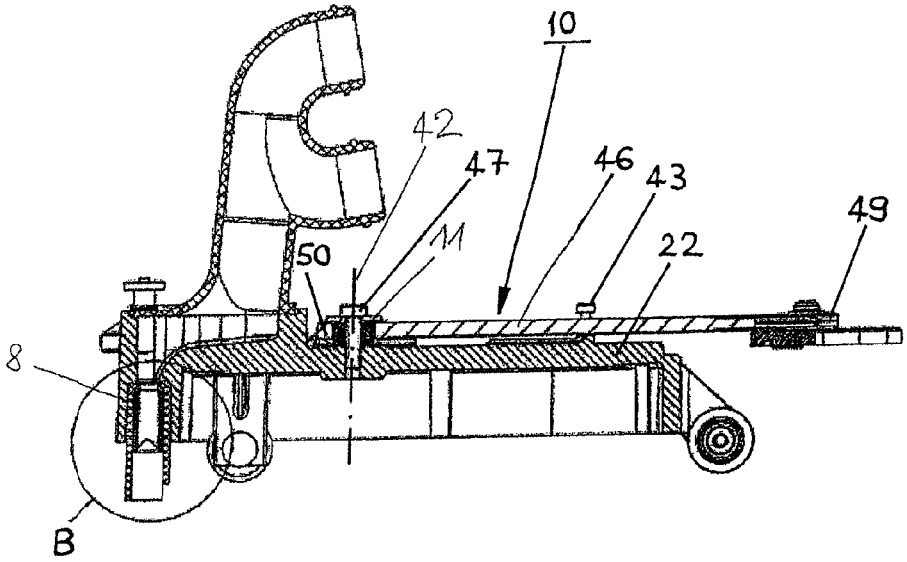
FIG. 4 illustrates a sectional view of the brush housing along the vertical middle plane.
Figure 5:
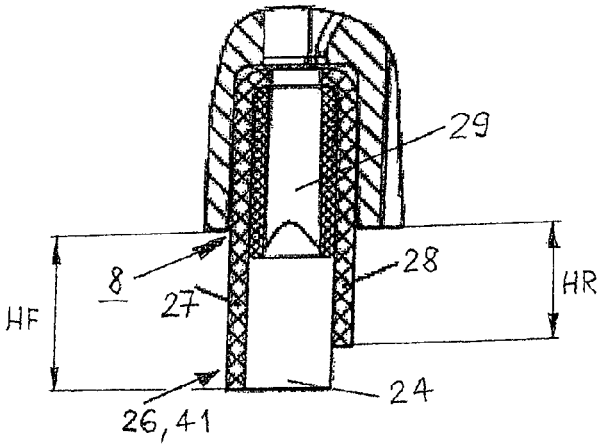
FIG. 5 illustrates a magnified sectional view of detail B in FIG. 4.

As illustrated in FIGS. 2-4 the suction device 25 comprises a rear suction unit 7 which is attached to the brush housing 22 by means of a resilient connecting device 10 permitting the rear suction unit 7 to move laterally with respect to the chassis 2 against an elastic resistance provided by the resilient connecting device 10. The resilient connecting device 10 can comprise an elongated bracket 46 having a first end 49 affixed to the rear suction unit 7 and a second end 50 attached to the brush housing 22 by means of an elastic connector 11. The first end 49 of the elongated bracket 46 can be Y-shaped to provide a rigid fixation of the rear suction unit 7. The elastic connector 11 preferably forms a pivot joint affixed to the brush housing 22 by means of a fastener 47, wherein the pivot joint has an axis 42 of rotation extending vertically with respect to a forward or backward travel direction of the cleaning apparatus 1. The elastic connector 11 can consist of a plastic or rubber. The outer periphery of the elastic connector 11 can be polygonally configured to prevent rotation between the elastic connector 11 and the elongated bracket 46 or can be rotationally stable affixed to the elongated bracket 46 by an adhesive or any other means known to the skilled person. By means of the elastic connector 11 the elongated bracket 46 is biased in a position of rest in which the elongated bracket 46 extends along a forward or backward travel direction of the cleaning apparatus 1. The rear suction unit 7 is rearwardly spaced apart from the brush housing 22 by a spacing of minimum 30%, preferably minimum 35% of the diameter of one of the brushes 20. Due to the fact that the elongated bracket 46 is elastically attached to the brush housing 22 the rear suction unit 7 can follow the path of the brushes 20 when the cleaning apparatus 1 is moved along a curved path or can be elastically pressed against a vertical wall when the cleaning apparatus 1 is moved along this wall closely enough to elastically press the rear suction unit 7 out of its position of rest against the elastic resistance provided by the elastic connector 11. Preferably, the rear suction unit 7 comprises a curved suction bar extending on an arc around a rear portion of the two brushes 20 so that the brushes are partially encircled. In embodiments of the cleaning apparatus 1 with two brushes the rear suction unit 7 is preferably configured as an essentially elliptically curved suction bar to better fit around a portion of the rear periphery of the pair of brushes 20. Further, each a stopper pin 43 can be mounted on the top side of the brush housing 22 on either side of the vertical middle plane 18 so as to limit the swiveling motion of the bracket 11. Preferably, the stopper pins 43 limit the swiveling motion of the bracket 11 within an angle of maximum ±60°, preferably of maximum ±45° and of minimum ±30°, preferably of minimum ±35°.

The suction device 25 can additionally comprise a front suction device 8 arranged in front of the brushes 20 and a vacuum turbine 5 which is operatively connected to the front suction unit 8 and to the rear suction unit 7. Each of the front and rear suction units 8, 7 can be attached to the brush housing 22. The front suction unit 8 can be configured as a linear suction bar and can comprises a front suction channel 29 and a closing mechanism 26 which closes the front suction channel 29 when the cleaning apparatus 1 is moved in a forward travel direction. The two brushes 20, the front suction unit 8 and the rear suction unit 7 define a floor contact region 44 for contacting the floor 12 to be cleaned when the cleaning apparatus 1 is in a working position as illustrated in FIG. 1. The closing mechanism 26 opens the front suction channel 29 when the cleaning apparatus 1 is tilted backwards so as to raise the floor contact region 44 relative to the rear wheels 3. Apart from this the closing mechanism 26 opens the front suction channel 29 when the cleaning apparatus 1 is moved in a backward travel direction. Furthermore, the rear suction unit 7 comprises a rear suction channel 30 which is open during movement of the cleaning apparatus 1 in the forward and the backward travel directions. By this means the suction volume flow rate of the cleaning unit 4 can simply be increased by moving the cleaning apparatus 1 in the backward travel direction while the vacuum applied to the rear suction unit 7 can be increased by moving the cleaning apparatus 1 in the forward travel direction in which the front suction unit 8 is closed. The front suction channel 29 comprises a suction opening 24 which is open towards a floor 12 to be cleaned over the entire length of the front suction unit 8. The closing mechanism 26 can be configured in such a way that it closes the suction opening 24 of the front suction channel 29 when the cleaning apparatus 1 is moved in a forward travel direction and opens the suction opening 24 when the cleaning apparatus 1 is moved in a backward travel direction. For this purpose the closing mechanism 26 can comprise a lip 41 which can be configured as a plastic or rubber gasket, wherein the lip 41 can have a front section 27 (FIGS. 4 and 5) which frontally limits the suction opening 24 along its entire length and a rear section 28 which rearwardly limits the suction opening 24 along its entire length. When the cleaning apparatus 1 is moved forward and backward in its working position with the floor contact region 44 contacting the floor 12 to be cleaned the closing mechanism 26 is actuated, i.e. closed and/or opened by frictional forces acting on the front section 27 of the lip 41 due to a sliding movement of the front section 27 on the floor 12 to be cleaned when the cleaning apparatus is moved in its forward travel direction, i.e. with the front portion 16 of the chassis 2 ahead or in the backward travel direction, i.e. with the rear portion 17 of the chassis 2 ahead.

Preferably, the front section 27 and the rear section 28 of the lip 41 are made of a resilient material. By this means the front section 27 of the lip 41 can be biased into its initial configuration where the front suction opening 24 is opened when the floor contact region 44 including the lip 41 is lifted from the floor 12 to be cleaned. The front section 27 of the lip 41 has a vertical height HF protruding from the bottom of the brush housing 22 and the rear section 28 of the lip 41 has a vertical height HR protruding from the bottom of the brush housing 22. Thereby, HF is larger than HR so that the front section 27 of the lip 41 is bendable across the suction opening 24 of the front suction channel 29. Upon moving the cleaning apparatus 1 in the forward travel direction the front section 27 of the lip 41 is bent under the rear section 28 and the suction slot 24 is closed. Upon moving the cleaning apparatus 1 in the backward travel direction the front section 27 of the lip 41 is pushed towards the front end 38 of the cleaning apparatus 1 so that the suction slot 24 of the front suction unit 8 is opened. Preferably, the front section 27 of the lip 41 is bendable as far as a portion of the front section 27 extends below the rear section 28 of the lip 41 so as to completely close the suction opening 24 of the front suction channel 29. The front suction unit 8 and the rear suction unit 7 extend transverse to the forward and backward travel direction of the cleaning apparatus 1 and—when measured orthogonal to a vertical middle plane 18 of the chassis 2—the front suction unit 8 and the rear suction unit 7 each have a length which is equal to or larger than a dimension of the two brushes 20 orthogonal to the vertical middle plane 18. Further, the rear suction unit 7 comprises a rear suction channel 30 and both of the front suction channel 29 and the rear suction channel 30 are connected to a manifold 31 so as to be in fluid connection with a single vacuum turbine 5. The vacuum turbine 5 is configured to create sufficient vacuum for active suction of the cleaning liquid in a forward and backward movement of the cleaning apparatus 1. The cleaning apparatus 1 is configured so that in a forward movement the entire vacuum performance is concentrated on the rear suction device 7. This due to the fact that during a forward movement the front section 27 of the lip 41 prevents any airflow at the front suction device 8. During backward movement the front suction unit 8 allows airflow and actively suck up of cleaning liquid. During backward movement both suction units front 8 and back 7 actively suck up cleaning liquids.

While various descriptions of the present invention are described above, it should be understood that the various features can be used singly or in any combination thereof. The scope of the present invention is accordingly defined as set forth in the appended claims.

The invention claimed is:

1. Floor cleaning apparatus comprising:

a front portion;

a rear portion, the rear portion comprising two lateral rear wheels;

a chassis; and a cleaning unit attached to the chassis, wherein the cleaning unit comprises a first tank, a second tank, at least one rotatable brush, wherein the at least one brush is arranged in the front portion of the cleaning apparatus so as to be contactable with the floor to be cleaned, a suction device including at least a rear suction unit arranged rearward of the at least one brush, and a brush housing, wherein the rear suction unit is attached to the brush housing by means of a resilient connecting device allowing the rear suction unit to move laterally with respect to the chassis against an elastic resistance provided by the resilient connecting device;

wherein the first tank is configured as a receptacle with a smallest dimension X and is attachable to the chassis with its smallest dimension X extending essentially vertically; and wherein the second tank is configured as a receptacle having a smallest dimension Z and is attachable to the rear portion of the cleaning apparatus with its smallest dimension Z oriented in the forward or rearward travel direction of the cleaning apparatus.

2. Cleaning apparatus according to claim 1, further comprising an elongated member which extends from a rear end of the chassis and wherein the second tank is attachable to the elongated member.

3. Cleaning apparatus according to claim 2, wherein one end of the elongated member is rotatably affixed to the chassis by means of a hinge.

4. Cleaning apparatus according to claim 3, wherein the hinge has a rotational axis extending in a lateral direction of the cleaning apparatus.

5. Cleaning apparatus according to claim 2, wherein the cleaning apparatus further comprises a handlebar and the elongated member extends from the chassis to the handlebar.

6. Cleaning apparatus according to claim 5, wherein the second tank has a smallest dimension Z extending essentially perpendicular to a plane defined by the elongated member and the handlebar.

7. Cleaning apparatus according to claim 5, further comprising a mechanical actuation device to rotate the elongated member about the rotational axis of the hinge.

8. Cleaning apparatus according to claim 7, wherein the mechanical actuation device is a lever hoist.

9. Cleaning apparatus according to claim 2, wherein the elongated member is adjustable and loosenably securable at a selected angle between −90° and +90° with respect to a horizontal plane.

10. Cleaning apparatus according to claim 1, wherein the at least one brush and the rear suction unit define a floor contact region when the cleaning apparatus is in a working position and wherein the first tank extends vertically with respect to the floor contact region to a level of maximum 40 cm.

11. Cleaning apparatus according to claim 1, wherein each of the first and second tanks has a volume of minimum 7 liters.

12. Cleaning apparatus according to claim 1, wherein each of the first and second tanks has a volume of maximum 12 liters.

13. Cleaning apparatus according to claim 1, wherein the first tank is detachably affixed to the chassis by means of a quick fixing device.

14. Cleaning apparatus according to claim 13, wherein the second tank is detachably affixed to the elongated member by means of a quick fixing device.

15. Cleaning apparatus according to claim 1, wherein the first tank longitudinally extends over the front and the rear portion of the cleaning apparatus.

16. Cleaning apparatus according to claim 1, wherein the resilient connecting device comprises an elastic connector which forms a pivot joint affixed to the brush housing by means of a fastener.

17. Cleaning apparatus according to claim 16, wherein the pivot joint has an axis of rotation extending essentially vertically.

18. Cleaning apparatus according to claim 1, wherein the rear suction unit comprises a curved suction bar.

19. Cleaning apparatus according to claim 18, wherein the curved suction bar is an essentially elliptically curved suction bar.

20. Cleaning apparatus according to claim 1, wherein the at least one brush is rotatable about a rotational axis extending essentially vertically.

21. Cleaning apparatus according to claim 1, wherein the cleaning apparatus further comprises a front suction unit including a closing mechanism which closes the front suction channel when the cleaning apparatus is moved in a forward travel direction and wherein the closing mechanism opens the front suction channel when the cleaning apparatus is in a working position and is moved in a backward travel direction.

22. Cleaning apparatus according to claim 1, wherein the rear suction unit comprises a rear suction channel which is open during movement of the cleaning apparatus in the forward and backward travel direction.

23. Cleaning apparatus according to claim 1, wherein the at least one brush and the rear suction unit define a floor contact region when the cleaning apparatus is in a working position and wherein the first tank extends vertically with respect to the floor contact region to a level of maximum 35 cm.

24. Cleaning apparatus according to claim 1, wherein each of the first and second tanks has a volume of minimum 9 liters.

25. Cleaning apparatus according to claim 1, wherein each of the first and second tanks has a volume of maximum 10 liters.

26. Cleaning apparatus according to claim 1, wherein the first tank is configured as a fresh water tank and the second tank is configured as a recovery water tank.

* * * * *